US005110445A

United States Patent [19]

Chen et al.

[11] Patent Number: 5,110,445

[45] Date of Patent: May 5, 1992

[54] LUBRICANT PRODUCTION PROCESS

[75] Inventors: Nai Y. Chen, Titusville; Randall D. Partridge, West Trenton, both of N.J.

[73] Assignee: Mobil Oil Corporation, Fairfax, Va.

[21] Appl. No.: 545,162

[22] Filed: Jun. 28, 1990

[51] Int. Cl.[5] ..... C10G 55/06

[52] U.S. Cl. ..... 208/96; 208/97; 208/59; 208/33; 585/737; 585/739; 585/738

[58] Field of Search ..... 208/59, 31, 33, 28, 208/27, 111, 96, 97; 585/737, 738, 739

[56] References Cited

U.S. PATENT DOCUMENTS

| | | | |
|---|---|---|---|
| 4,678,556 | 7/1987 | Hicks et al. | 208/33 |
| 4,764,266 | 9/1988 | Chen et al. | 208/58 |
| 4,911,821 | 3/1990 | Katzer et al. | 208/77 |
| 4,913,797 | 4/1990 | Albinson et al. | 208/89 |
| 4,919,788 | 4/1990 | Chen et al. | 208/39 |
| 4,952,303 | 8/1990 | Bortz et al. | 208/216 R |

*Primary Examiner*—Helane E. Myers

*Attorney, Agent, or Firm*—Alexander J. McKillop; Charles J. Speciale; Malcolm D. Keen

[57] ABSTRACT

Hydrocarbon lubricants having a high viscosity index (V.I.) and low pour point are produced by hydroisomerizing a waxy lube feed such as slack wax or a waxy gas oil over zeolite beta after which aromatic components are removed by extraction, e.g. with furfural. The raffinate is then dewaxed, preferably by solvent dewaxing to target pour point with a final hydrofinishing step. The hydroisomerization coupled with the aromatics extraction and dewaxing increases the range of crudes that can be processed into high V.I. lubes while maintaining equivalent product qualities. Hydrogen consumption in the process is relatively low.

14 Claims, No Drawings

LUBRICANT PRODUCTION PROCESS

FIELD OF THE INVENTION

The present invention relates to a process for the production of lubricants and more particularly, to a process for the production of hydrocarbon lubricants of high viscosity index.

BACKGROUND OF THE INVENTION

Mineral oil lubricants are derived from various crude oil stocks by a variety of refining processes which are directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity, poor viscosity indices and poor oxidative stability, the use of asphaltic type crudes is not preferred as the yield of acceptable lube stocks will be extremely low after the large quantities of aromatic components contained in such crudes have been separated out; paraffinic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as phenol, furfural or N-methylpyrrolidone (NMP) or another material which is selective for the extraction of the aromatic components. If the lube stock is a residual lube stock, the asphaltenes will first be removed in a propane deasphalting step followed by solvent extraction of residual aromatics to produce a lube generally referred to as bright stock. In either case, however, a dewaxing step is normally necessary in order for the lubricant to have a satisfactorily low pour point and cloud point, so that it will not solidify or precipitate the less soluble paraffinic components under the influence of low temperatures.

A number of dewaxing processes are known in the petroleum refining industry and of these, solvent dewaxing with solvents such as methylethylketone (MEK) and liquid propane, has been the one which has achieved the widest use in the industry. Recently, however, proposals have been made for using catalytic dewaxing processes for the production of lubricating oil stocks and these processes possess a number of advantages over the conventional solvent dewaxing procedures. The catalytic dewaxing processes which have been proposed are generally similar to those which have been proposed for dewaxing the middle distillate fractions such as heating oils, jet fuels and kerosenes, of which a number have been disclosed in the literature, for example, in Oil and Gas Journal, Jan. 6, 1975, pp. 69–73 and U.S. Pat. No(s). RE 28,398, 3,956,102 and 4,100,056. Generally, these processes operate by selectively cracking the longer chain end paraffins to produce lower molecular weight products which may then be removed by distillation from the higher boiling lube stock. The catalysts which have been proposed for this purpose have usually been zeolites which have a pore size which admits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, ZSM-35 and ZSM-38 have been proposed for this purpose in dewaxing processes, as described in U.S. Pat. No(s). 3,894,938, 4,176,050, 4,181,598, 4,222,855, 4,229,282 and 4,247,388. A dewaxing process employing synthetic offretite is described in U.S. Pat. No. 4,259,174.

Although the catalytic dewaxing processes are commercially attractive because they do not produce quantities of solid paraffin wax which presently is regarded as an undesirable, low value product, they do have certain disadvantages and because of this, certain proposals have been made for combining the catalytic dewaxing processes with other processes in order to produce lube stocks of satisfactory properties. For example, U.S. Pat. No. 4,181,598 discloses a method for producing a high quality lube base stock by subjecting a waxy fraction to solvent refining, followed by catalytic dewaxing over ZSM-5 with subsequent hydrotreatment of the product. U.S. Pat. No. 4,428,819 discloses a process for improving the quality of catalytically dewaxed lube stocks by subjecting the catalytically dewaxed oil to a hydroisomerization process which removes residual quantities of petrolatum wax which contribute to poor performance in the Overnight Cloud Point test (ASTM D2500-66). This process is intended to overcome one disadvantage of the intermediate pore dewaxing catalysts such as ZSM-5 which is that the normal paraffins are cracked much faster than the slightly branched chain paraffins and cycloparaffins so that, although a satisfactory pour point is attained (because the straight chain paraffins are removed) residual quantities of branched chain paraffins and cycloparaffins may be left in the oil, to contribute to a poor performance in the Overnight Cloud Point test when the oil is subjected to a relatively low temperature for an extended period of time. During this time, the petrolatum wax which is made up of the less soluble slightly branched chain paraffins and cycloparaffins, nucleates and grows into wax crystals of a sufficient size to produce a perceptible haze. Although it would be possible to remove the petrolatum wax by operating the dewaxing process at a higher conversion so that these components were removed together with the straight chain paraffins, the yield loss which would result, has generally been considered unacceptable.

As mentioned above, the conventional catalytic dewaxing processes using intermediate pore size zeolites such as ZSM-5 operate by selectively cracking the waxy components of the feed. This results in a loss in yield since the components which are in the desired boiling range undergo a bulk conversion to lower boiling fractions which, although they may be useful in other products, must be removed from the lube stock. A notable advance in the processing of lube stocks is described in U.S. Pat. No(s). 4,419,220 and 4,518,485, in which the waxy components of the feed, comprising straight chain and slightly branched chain paraffins, are removed by isomerization over a catalyst based on zeolite beta. During the isomerization, the waxy components are converted to relatively less waxy isoparaffins and at the same time, the slightly branched chain paraffins undergo isomerization to more highly branched aliphatics. A measure of cracking does take place during the operation so that not only is the pour point reduced by reason of the isomerization but, in addition, the heavy ends undergo some cracking or hydrocracking to form liquid range materials which contribute to a low viscosity product. The degree of cracking is, however, limited so as to maintain as much of the feedstock as possible in the desired boiling range. As mentioned above, this process uses a catalyst which is based on zeolite beta, together with a suitable hydrogenation-dehydrogenation component which is typically a base metal or a noble metal, usually of group VIA or VIIIA of the Periodic Table of the Elements (the periodic table used in this specification is the table approved by IUPAC), such as cobalt, molybdenum, nickel, tungsten, palladium or platinum. As described in U.S. Pat. No. 4,518,485, the isomerization dewaxing step may be proceeded by a hydrotreating step in order to remove heteroatom-containing impurities, which may be separated in an interstage separation process similar to that employed in two-stage hydrotreating-hydrocracking processes.

The zeolite beta dewaxing process has significant advantages for dewaxing extremely waxy feeds, for example, Pacific and South-East Asian gas oils which may have upwards of 50 percent paraffins. Enhanced utilization of the properties of zeolite beta may, however, be secured by utilizing it in combination with other processing steps. For example, European Patent Application Publication No. 225,053 (corresponding to U.S. application Ser. No. 793,937, filed Nov. 1, 1985 now abandoned) utilizes an initial hydroisomerization step using a zeolite beta catalyst followed by a selective dewaxing over ZSM-5 or ZSM-23 or even solvent dewaxing to produce a product of high V.I. and low pour point. The initial hydroisomerization effectively removes waxy components from the back end of the feeds by isomerizing them to high V.I. isoparaffins and the subsequent selective dewaxing step preferentially removes front end waxes to obtain the target pour point. Extremely waxy stocks such as slack wax and deoiled wax are of particular utility in this process, as described in U.S. Ser. No. 044,187, filed Apr. 27, 1987 now abandoned. Conventional high pressure hydroisomerization processes used in the production of very high V.I. lubes (120–145 V.I.) typically employ pressures over 1500 psig (about 10,440 kPa abs.). See, for example, Developments in Lubrication PD19(2), 221–228 (Bull). Unlike these, the zeolite beta isomerization process operates well at low to moderate hydrogen pressures e.g. 300–1250 psig (about 2170–8720 kPa abs.) and is therefore readily accommodated in existing low pressure refinery units e.g. CHD units. In addition, the feed for the zeolite beta isomerization process may be obtained from various refinery streams including slack waxes and deoiled waxes as mentioned above as well as straight run gas oil (VSO) and de-asphalted oil (DAO). The conventional high pressure process, however, usually employs wax feeds of specific character derived from aromatics extraction or hydrocracking of a crude prior to dewaxing.

Regardless of the nature of the feed, certain problems may arise. One is that a certain degree of cracking takes place during the isomerization process at the acidic sites on the zeolite beta catalyst. This cracking will cause dealkylation of some of the long chain alkyl substituted aromatic components so that cracking products including polycyclic aromatics within the lube boiling range but of extremely poor V.I. and oxidation stability are obtained. These components may adversely affect the properties of the final lube product. In addition, a disparity between the pour point (ASTM D-97 or equivalent method e.g. Autopour) and cloud point (ASTM D-2500-66) may develop, as described above as a result of certain waxes, primarily of a naphthenic character remaining in the oil after the isomerization-dewaxing step.

SUMMARY OF THE INVENTION

We have now devised a process for producing lubricant products of high V.I., low pour point and good oxidation stability. According to the present invention the lubricants are produced by a process which includes:

(i) hydroisomerizing a waxy lube feed by contact with a zeolite beta hydroisomerization catalyst,
(ii) extracting aromatics from the hydroisomerized feed with a solvent which is selective for aromatics,
(iii) dewaxing the extracted, hydroisomerized feed, preferably by solvent dewaxing, to lower its pour point,
(iv) hydrofinishing the dewaxed product.

The hydroisomerization step is effective for removing organic sulfur-containing materials from the feed and for this reason, the aromatic components separated during the solvent extraction are low-sulfur or sulfur-free fractions which can be separated from the solvent as useful products.

DETAILED DESCRIPTION

Feedstock

The first step of the present process is a hydroisomerization of the waxy paraffins present in the feed. The waxy feeds which may be used are those which are described in EP 225,053, referred to above with particular preference given to the wax feeds described in U.S. Ser. No. 044,187, filed April 27, 1987 now abandoned, to which reference is made for a disclosure of such feeds. For convenience, a brief description of these feeds is given below.

The feedstock for the present process may generally be characterized as a lube fraction prepared from a crude stock of suitable characteristics e.g. by distillation in atmospheric and vacuum towers, after which the lube stock will be subjected to removal of the aromatics using a suitable solvent such as furfural, phenol or NMP, and, in the case of residual fractions, by deasphalting prior to solvent extraction. At this point, the lube stock will typically have a boiling point above the distillate range, i.e. above about 345° C. (about 650° F.) but the lube stocks which may be used are generally characterized in terms of their viscosity rather than their boiling ranges since this is a more important characteristic for a lubricant. Generally, the neutral stocks will have a viscosity in the range of 100 to 750 SUS (20 to 160 cSt) at 40° C. (99° F.) and in the case of a bright stock, the viscosity will generally be in the range of 1000 to 3000 SUS (210 to about 600 cSt) at 99° C. (210° F.).

The distillate (neutral) base stocks may generally be characterized as paraffinic in character, although they also contain naphthenes and aromatics and because of their paraffinic character, they are generally of fairly low viscosity and high viscosity index. The residual stocks such as bright stock will be more aromatic in character and for this reason will generally have higher viscosities and lower viscosity indices. In general, the aromatic content of the stock will be in the range of 10 to 70 weight percent, usually 15 to 60 weight percent with the residual stocks having the relatively higher aromatic contents, typically 20 to 70 weight percent, more commonly 30 to 60 weight percent and the distillate stocks having lower aromatic contents, for instance, 10 to 30 weight percent. Fractions in the gas oil boiling range (315° C.+(600° F.+)) with an end point usually below about 565° C. (about 1050° F.) are a convenient feed because they can generally be treated by the present process to produce high quality lubes.

In addition to lube stocks produced directly from crudes, as described above, the present dewaxing process is capable of using other petroleum refinery streams of suitable characteristics and refining them so as to produce lubricants of extremely good properties. Reference is made to Ser. No. 044,187 for a description of slack waxes and de-oiled waxes which may be used in the present process. In particular, it is capable of producing lubricants from highly paraffinic refinery streams such as those obtained from the solvent dewaxing of distillates and other lube fractions, commonly referred to as slack wax. These streams are highly paraffinic in nature and generally will have a paraffin content of at least 50, more usually at least 70, weight percent with the balance from the occluded oil being divided between aromatics and naphthenics. These waxy, highly paraffinic stocks usually have much lower viscosities than the neutral or residual stocks because of their relatively low content of aromatics and naphthenes which are high viscosity components. The high content of waxy paraffins, however, gives them melting points and pour points which render them unacceptable as lubricants. Because the highly siliceous, large pore zeolite dewaxing catalysts used in the present process are able to isomerize the straight chain and slightly branched-chain paraffins to the less waxy iso-paraffins, they are able to process these highly paraffinic streams into lubricants of extremely good VI. Compositions of some typical slack waxes are given in Table 1 below.

TABLE 1

| Slack Wax Composition - Arab Light Crude | A | B | C | D |
|---|---|---|---|---|
| Paraffins, wt. pct. | 94.2 | 91.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

Excessively high aromatic contents should be avoided as they will either give poor yields after the aromatics are removed or, if not removed, will result in lubricants products with high viscosity, low VI and poor stability.

A typical highly paraffinic gas oil fraction which may be treated by the present process to form a high quality, high VI lube is a 345°-540° C. (650°-1000° F.) Minas gas oil having the properties set out in Table 2 below.

TABLE 2

| Minas Gas Oil | |
|---|---|
| Nominal boiling range, °C. (°F.) | 371°-510° (7000°-950°) |
| API Gravity | 33.0 |
| Hydrogen, wt % | 13.6 |
| Sulfur, wt % | 0.07 |
| Nitrogen, ppmw | 320 |
| Basic Nitrogen, ppmw | 160 |
| CCR | 0.04 |
| Composition, wt % | |
| Paraffins | 60 |
| Naphthenes | 23 |
| Aromatics | 17 |
| Bromine No. | 0.8 |

TABLE 2-continued

| Minas Gas Oil | |
|---|---|
| KV, 100° C., cSt | 4.18 |
| Pour Point, °C. (°F.) | 46 (115) |
| 95% TBP, °C. (°F.) | 510 (950) |

Highly paraffinic feeds such as this will generally have a pour point of at least 40° C.; wax feeds such as slack wax will usually be solid at ambient conditions.

Other high boiling fractions which may be used as feeds for the present process include synthetic lubricant fractions derived, for example, from shale oil by synthesis from natural gas, coal or other carbon sources. A particularly useful feed is the high boiling fraction obtained from the Fischer-Tropsch synthesis since this contains a high proportion of waxy paraffins which can be converted to highly iso-paraffinic components by the present process.

The waxy feed may be hydrotreated before the hydroisomerization in order to remove heteroatom containing impurities and to hydrogenate at least some of the aromatics which may be present to form naphthenes. Inorganic nitrogen and sulfur formed during the hydrotreating may be removed by a conventional separation prior to the catalytic dewaxing. Conventional hydrotreating catalysts and conditions are suitably used as described in EP 225,053.

Hydroisomerization

In the first step of the present process, the feed is subjected to isomerization over zeolite beta, a large pore, siliceous zeolite catalyst. Although isomerization does not require hydrogen for stoichiometric balance, the presence of hydrogen is desirable in order to promote certain steps in the isomerization mechanism and also to maintain catalyst activity. Also, because the isomerization steps entail hydrogenation and dehydrogenation, the catalyst will contain a hydrogenation-dehydrogenation component in addition to the zeolite. The hydrogenation-dehydrogenation component (referred to, for convenience, as a hydrogenation component) is generally a metal or metals of groups IB, IVA, VA, VIA, VIIA or VIIIA of the Periodic Table, preferably of Groups VIA or VIIIA and may be either a base metal such as cobalt, nickel, vanadium, tungsten, titanium or molybdenum or a noble metal such as platinum, rhenium, palladium or gold. Combinations of base metals such as cobalt-nickel, cobalt-molybdenum, nickel-tungsten, cobalt-nickel-tungsten or cobalt-nickel-titanium may often be used to advantage and combinations or noble metals such as platinum-palladium may also be used, as may combinations of base metals with noble metals, such as platinum-nickel. These metal components may be incorporated into the catalyst by conventional methods such as impregnation using salts of the metals or solutions of soluble complexes which may be cationic, anionic or neutral in type. The amount of the hydrogenation component is typically from 0.01 to 10% by weight of catalyst with the more highly active noble metals being used at lower concentrations, typically from 0.1 to 1% whereas the base metals are normally present in relatively higher concentrations, e.g. 1 to 10%.

In addition to the hydrogenation component the hydroisomerization catalyst includes zeolite beta as an acidic (cracking) component. The pore structure of zeolite beta gives it highly desirable selective properties. Zeolite beta is a known zeolite which is described in U.S. Pat. No(s). 3,308,069 and RE 28,341, to which reference is made for further details of this zeolite, its preparation and properties. The preferred forms of zeolite beta for use in the present process are the high silica forms, having a silica alumina ratio of at least 30:1 and it has been found that ratios of at least 50:1 or even higher, for example, 100:1, 250:1, 500:1, may be used to advantage because these forms of the zeolite are less active for cracking than the less highly siliceous forms so that the desired isomerization reactions are favored at the expense of cracking reactions which tend to effect a bulk conversion of the feed, forming cracked products which are outside the desired boiling range for lube components. Steamed zeolite beta with a higher silica:alumina ratio (framework) than the synthesized form of the zeolite is preferred. Suitable catalysts of this type used in the present process are described in U.S. Pat. No(s). 4,419,220 and 4,518,485 and EP 225,053, to which reference is made for a more detailed description of these zeolite beta based catalysts. As mentioned in the two patents, the silica:alumina ratios referred to in this specification are the structural or framework ratios and the zeolite, whatever its type, may be incorporated into a matrix material such as clay, silica or a metal oxide such as alumina or silica alumina.

The initial step in the process isomerizes the long chain waxy paraffins in the feed to form iso-paraffins which are less waxy in nature but which possess a notably high viscosity index. At the same time, the acidic function of the zeolite will promote a certain degree of cracking or hydrocracking so that some conversion to products outside the lube boiling range will take place. This is not, however, totally undesirable, because if significant quantities of aromatics are present in the feed they will tend to be removed by hydrocracking, with consequent improvements in the viscosity and VI of the product. The extent to which cracking reactions and isomerization reactions will predominate will depend on a number of factors, principally the nature of the zeolite, its inherent acidity, the severity of the reaction (temperature, contact time) and, of course, the composition of the feedstock. In general, cracking will be favored over isomerization at higher severities (higher temperature, longer contact time) and with more highly acidic forms of the zeolite. Thus, a higher zeolite silica:alumina ratio will generally favor isomerization and therefore will normally be preferred, except possibly to handle more aromatic feeds. The acidity of the zeolite may also be controlled by exchange with alkali metal cations, especially monovalent cations such as sodium and divalent cations such as magnesium or calcium, in order to control the extent to which isomerization occurs relative to cracking. The extent to which isomerization will be favored over cracking will also depend upon the total conversion, itself a factor dependent upon severity. At high conversions, typically over about 80 volume percent, isomerization may decrease fairly rapidly at the expense of cracking; in general, therefore, the total conversion by all competing reactions should normally be kept below about 80 volume percent and usually below about 70 volume percent.

The relationships between cracking reactions and isomerization reactions for these zeolites are described in some greater detail in U.S. application Ser. No. 379,423 and its counterpart EP 94,826, to which reference is made for such a description.

The selection of the metal hydrogenation-dehydrogenation component will also have a bearing on the relative balance of reactions. The more highly active noble metals, especially platinum, promote hydrogenation-dehydrogenation reactions very readily and therefore tend to promote isomerization at the expense of cracking because paraffin isomerization by a mechanism involving dehydrogenation to olefinic intermediates followed by hydrogenation to the isomer products. The less active base metals, by contrast, will tend to favor hydrocracking therefore may commend themselves when it is known that cracking reactions may be required to produce a product of the desired properties. Base metal combinations such as nickel-tungsten, cobalt-molybdenum or nickel-tungsten-molybdenum may be especially useful in these instances.

The hydroisomerization in the first stage is carried out under conditions which promote the isomerization of the long chain, waxy paraffinic components to iso-paraffins to increase the V.I. of the product. Generally, the conditions may be described as being of elevated temperature and pressure. Temperatures are normally from 250° C. to 500° C. (about 480° to 930° F.), preferably 400° to 450° C. (about 750° to 850° F.) but temperatures as low as 400° C. (about 205° C. ) may be used for highly paraffinic feedstocks. Because the use of lower temperatures tends to favor the desired isomerization reactions over the cracking reactions, the lower temperatures will generally be preferred although it should be remembered that since the degree of cracking which will to some extent inevitably take place will be dependent upon severity, a balance may be established between reaction temperature and average residence time in order to achieve an adequate rate of isomerization while minimizing cracking. Pressures may range up to high values, e.g. up to 25,000 kPa (3,600 psig), more usually in the range 4,000 to 10,000 kPa (565 to 1,435 psig). The possibility of using low hydrogen pressures e.g. below about 1000 psig (about 7000 kPa abs.) is a particularly advantageous feature of the present process, as compared to high pressure hydrocracking/isomerization processes operating typically at about 2000 psig (about 13900 kPa abs.) or higher. Space velocity (LHSV) is generally in the range of 0.1 to 10 $hr.^{-1}$, more usually 0.2 to 5 $hr.^{-1}$. The hydrogen:feed ratio is generally from 50 to 1,000 $n.l.l.^{-1}$ (about 280 to 5617 SCF/bbl), preferably 200 to 400 $n.l.l.^{-1}$ (about 1125 to 2250 SCF/Bbl). Net hydrogen consumption will depend upon the course of the reaction, increasing with increasing hydrocracking and decreasing as isomerization (which is hydrogen-balanced) predominates. The net hydrogen consumption will typically be under about 40 $n.l.l.^{-1}$ (about 224 SCF/Bbl) with the feeds of relatively low aromatic content such as the paraffinic neutral (distillate) feeds and slack wax and frequently will be less, typically below 35 $n.l.l.^{-1}$ (about 197 SCF/Bbl); with feeds which contain higher amounts of aromatics higher net hydrogen consumptions should be anticipated, typically in the range of 50-100 $n.l.l.^{-1}$ (about 280-560 SCF/Bbl), e.g. from 55-80 (about 310-SCF/Bbl). Process configuration will be as described in U.S. Pat. No(s). 4,419,220 and 4,518,485, i.e. with downflow trickle bed operation being preferred.

With highly paraffinic feeds of low aromatic content, such as slack wax, it will be desirable to maximize isomerization over hydrocracking and therefore relatively low temperatures, e.g. from 250° to 400° C. (about 480° to 750° C.) will be preferred together with relatively low severities, e.g. space velocities (LHSV) of about 1 to 5, and catalysts of relatively low acidity. As a general guide, the bulk conversion to products outside the lube boiling range will be at least 10 weight percent and usually in the range 10 to 50 weight percent, depending upon the characteristics of the feed, the properties desired for the product and the desired product yield. With most feeds it will be found that there is an optimum conversion for VI efficiency, or yield efficiency, that is, for maximum VI relative to yield or maximum yield and in most cases, this will be in the range of 10–50 weight percent conversion, more commonly 15–40 weight percent conversion.

Selection of the severity of the hydroisomerization step is an important part of the present process because it is not possible to remove the straight chain and slightly branched chain waxy components in a completely selective manner, while retaining the desirable more highly branched chain components which contribute to high VI in the product. For this reason, the degree of dewaxing by isomerization which is achieved in the first step, is preferably limited so as to leave a residual quantity of waxy components which are then removed in the second (solvent) step. The objective of maximizing the isoparaffinic content of the effluent from the catalytic dewaxing step so as to obtain the highest VI in the final product may be achieved by adjusting the severity of the initial dewaxing operation until the optimum conditions are reached for this objective. Further details of the hydroisomerization are found in Ser. No. 793,937 and EP 225,053 to which reference is made for this purpose.

Solvent Extraction

Following the hydroisomerization the lube is subjected to extraction of aromatic components by contact with a solvent which is selective for aromatics. Solvents of this type which are particularly applicable with lube feeds include phenol, furfural and N-methyl-2-pyrrolidone (NMP) although other selective solvents may be employed. The extraction may be carried out in a conventional manner with solvent:oil ratios and extraction temperatures and durations adjusted to achieve the desired degree of aromatics removal which is itself determined by the characteristics desired in the final lube product, especially viscosity and oxidation stability.

The temperature and dosage of extraction solvent in this step is controlled to provide high VI products. The fact that the oils to be extracted are already of a low pour point by reason of the hydroisomerization improves the selectivity of the aromatic rejection step in two ways. It improves the miscibility of oil and extraction solvent, and it allows the extraction to be carried out at considerably lower temperatures than would be otherwise. Lower extraction temperatures allow very selective rejection of aromatics. For furfural extraction in this proposed process extraction temperatures may now be varied from the usual high of 275° F. to as low as 20° F. Conventional lube processes would not allow temperatures much below 125° F. because of the need to process high pour oils. Temperatures of 100° to 200° F. will normally be preferred. Solvent:oil ratios of 1 to 5, preferably 1.5 to 2.5 (by weight), using furfural as the solvent, are typical. The extracts provide a useful source of sulfur-free or low-sulfur aromatic products which can be recovered from the solvent by conventional processing techniques such as distillation.

The composition of a typical furfural extract derived from a hydroisomerized Minas gas oil is given below in Table 3.

TABLE 3

| Composition of Furfural Extract | |
|---|---|
| Yield on gas oil, wt. pct. | 7.1 |
| Yield on HDI, wt. pct. | 11.3 |
| API Gravity | 4.6 |
| Hydrogen, wt. pct. | 9.33 |
| Sulfur, wt. pct. | 0.105 |
| Nitrogen, wt. pct. | 0.235 |
| Aromatics, wt. pct. | >90 |
| Pour pt., °F. | +60 |

Dewaxing

The extracted oil is then subjected to a dewaxing step which has two principal objectives. First, it will reduce the pour point to the target value. Second, if a selective solvent dewaxing is used, a divergence between product pour point and cloud point can be avoided. Solvent dewaxing is therefore preferred for this step of the process and may be carried according to conventional prescriptions for achieving the desired product pour point e.g. solvent/oil ratio, chill temperature etc. Conventional solvents such as methyl ethyl ketone (MEK)-/toluene mixtures may be used or autorefrigerants such as propane. It is, however, possible to use highly selective solvents such as 100% MEK in the present process because with the highly paraffinic streams produced by the use of waxy feeds followed by the removal of the aromatics in the solvent extraction step, the phase separations observed with less highly paraffinic materials have not been found to occur. This phenomenon may be occasioned by the relative absence of aromatics coupled with the relatively high proportion of iso-paraffins. The use of such highly selective solvent dewaxing procedures is desirable because of the highly favorable separation of the waxy components, which it achieves while, at the same time, leaving the high V.I. iso-paraffins in the oil. However, less selective solvent mixtures may be used if desired, for example, MEK/toluene with 60 to 80 percent (v/v) MEK. The wax separated in the solvent dewaxing may be recycled to the initial isomerization step for further improvement in product quality and process efficiency. Catalytic dewaxing may also be employed at this stage of the process, for example, using an intermediate pore size dewaxing catalyst such as ZSM-5 or ZSM-23 in any of the catalytic dewaxing processes disclosed in the patents identified above, to which reference is made for a description of such processes. Catalytic dewaxing over zeolite ZSM-23 is especially preferred, particularly for light lube stocks e.g. up to 200 SUS light neutral because of the highly selective nature of the dewaxing with this zeolite. Dewaxing with ZSM-23 is described in U.S. Pat. No. 4,222,855 to which reference is made for a disclosure of the process. Catalytic dewaxing is preferred when extremely low pour point (< −20 F.) lubricant products are desired.

Dewaxing at this stage is carried out to reduce the pour point to the desired value, typically below 10° F. (about −12° C.) and usually lower e.g. 5° F. (−15° C.). Dewaxing severity will be adjusted according to the desired pour point or other fluidity characteristic (cloud point, freeze point etc). Although increasing low pour points will result in lower yields as progressively more of the waxy paraffin content is removed in the processing. However, the iso-paraffinic character of the oil produced by the initial hydroisomerization step results in higher yields at higher VI levels than would otherwise be achieved.

Hydrofinishing

After dewaxing, the oil is hydrofinished to improve its lubricant quality by saturating residual lube boiling range olefins and removing color bodies and other sources of instability. If the hydrofinishing pressure is high enough, saturation of residual aromatics may also take place. Hydrofinishing conditions may be conventional for lube hydrofinishing, typically at 400°-700° F. (about 205°-370° C.), 400-5000 psig (about 2860-20,800 kPa abs.), 0.1-5 LHSV, 500-10,000 SCF/Bbl $H_2$:oil (about 90-1780 n.l.l.$^{-1}$ $H_2$:oil). Catalysts typically comprise a metal hydrogenation component on an essentially non-acidic porous support such as alumina, silica or silica-alumina. The metal component is usually a base metal of Group VIA or VIIIA, or a combination of such metals, such as nickel, cobalt, molybdenum, cobalt-molybdenum or nickel-cobalt. Hydrofinishing catalysts of this type are conventional and readily available commercially. Hydrofinishing is particularly desirable after catalytic dewaxing by a shape-selective cracking process e.g. dewaxing over ZSM-5, because of the presence of lube range olefins in the dewaxed product which would otherwise lead to product instability.

The products of the present process are lubricants of high VI and low pour point and excellent oxidational stability, a combination of properties conferred by the presence of significant quantities of iso-paraffins coupled with relative freedom from aromatics. The use of the initial hydroisomerization in combination with the subsequent selective dewaxing enables high VI to be coupled with low product pour point, as together with high efficiency in the process, either as to VI efficiency or yield efficiency. In addition, the use of the solvent extraction before the dewaxing step promotes high efficiency in the dewaxing.

EXAMPLE

A premium quality lube base stock was prepared from a waxy Minas vacuum gas oil similar to the oil whose composition is set out in Table 2.

Minas 700°-950° F. (400°-510° C.) boiling range VGO, having a pour point of +115° F. (46° C.) and containing about 58% wt. total paraffins (mainly n-paraffins), was processed over a Pt/zeolite beta catalyst (0.6% wt. platinum-exchanged extrudate containing 65% zeolite beta and 35% gamma alumina, steamed to 75 alpha value) to obtain, by distillation, a +40° F. (4° C.) pour point 700° F.+ (370° C.+) product in 62.7% wt. yield.steamed to an alpha value of about 75. The process conditions were 790° F. (420° C.), 400 psig (2860 kPa abs.), 1.0 hr$^{-1}$ LHSV and 2500 SCF/B (445 n.1$^{-1}$1.$^{-1}$) hydrogen flow at the inlet of the reactor (trickle bed).

The 700° F.+ bottoms product from the preceding step was then extracted twice using furfural at 150° F. (65° C.) in a 2:1 ratio in each extraction. The yield of raffinate was 88.7%, and aromatics in the oil were reduced from 24.8% to 18.5% by weight. The pour point increased to +50° F. (10° C.).

The furfural raffinate was then dewaxed using 100% MEK at 0° F. to obtain a +5° F. (−15° C.) pour point product in 80.0% yield. This product contained 23.0% wt. aromatics and 51.4% wt. paraffins (mainly iso-paraffins—no n-paraffins by GC analysis).

The dewaxed oil was hydrofinished at 550° F. (290° C.), 2600 psig (18030 kPa abs.), 0.3 hr$^{-1}$, using a commercial Ni-Mo/gamma-$Al_2O_3$ catalyst (sulfided). The hydrofinished product contained less than 5% wt. aromatics, and had an ASTM color of 0.0.

Yield loss and hydrogen consumption were minimal with greater than 98% recovery at about 300 SCF/B 53.4 hydrogen consumption.

The final hydrofinished product was obtained in 43.6% wt. yield, and had a pour point of +5° F. (−15° C.). This product contained about 50% paraffins and had a VI of 119 and a viscosity of 22.4 cs at 40° C. This product with a standard additive package exceeded 3000 hours of TOST testing with an acid number less than 0.3 (TOST=Turbine Oil Stability Test, ASTM D-943).

We claim:

1. A process for producing a hydrocarbon lubricant, which comprises:

(i) hydroisomerizing a waxy lube feed by contact in the presence of hydrogen with a zeolite beta hydroisomerization catalyst, (ii) extracting aromatics from the hydroisomerized feed with a solvent which is selective for aromatics, (iii) dewaxing the extracted, hydroisomerized feed to lower its pour point and form a dewaxed lube product, (iv) hydrofinishing the dewaxed product.

2. A process according to claim 1 in which the lube feed is hydroisomerized by contact with a zeolite beta hydroisomerization catalyst at a temperature from 400° to 850° F., a pressure from 200 to 1500 psig and a space velocity of 0.1 to 10 LHSV.

3. A process according to claim 2 in which the zeolite beta hydroisomerization catalyst comprises platinum on zeolite beta.

4. A process according to claim 1 in which the aromatics are extracted from the hydroisomerized oil with furfural, N-methyl-pyrrolidone or phenol.

5. A process according to claim 1 in which the extracted, hydroisomerized oil is dewaxed by solvent dewaxing.

6. A process according to claim 5 in which the solvent comprises at least 80 vol. percent methyl ethyl ketone.

7. A process according to claim 5 in which the solvent comprises at least 100 vol. percent methyl ethyl ketone.

8. A process according to claim 1 in which the dewaxed oil is hydrofinished at a pressure of 400 to 3000 psig and a temperature of 400° to 700° F.

9. A process according to claim 1 in which the lubricant is produced with a hydrogen consumption of not more than 500 SCF/Bbl in steps (i) and (iii) of the process.

10. A process according to claim 1 in which the product lubricant has a VI of at least 110 and a pour point not higher than 5° F.

11. A process for producing a low sulfur aromatic fraction and a hydrocarbon lubricant, which comprises:

(i) hydroisomerizing a waxy lube feed by contact in the presence of hydrogen with a zeolite beta hydroisomerization catalyst, (ii) extracting aromatics from the hydroisomerized feed with a solvent which is selective for aromatics, (iii) separating the extracted aromatic components from the solvent to form a low sulfur aromatic product, (iv) dewaxing the extracted, hydroisomerized feed, to lower its pour point and form a dewaxed lube product, (iv) hydrofinishing the dewaxed lube product.

12. A process according to claim 11 in which the feed is hydroisomerized by contact with a zeolite beta hydroisomerization catalyst at a temperature from 400° to 850° F., a pressure from 200 to 1500 psig and a space velocity of 0.1 to 10 LHSV.

13. A process according to claim 12 in which the zeolite beta hydroisomerization catalyst comprises platinum on zeolite beta.

14. A process according to claim 11 in which the aromatics are extracted from the hydroisomerized oil with furfural, N-methyl-pyrrolidone or phenol.

* * * * *